US007866647B2

(12) United States Patent
Terao et al.

(10) Patent No.: US 7,866,647 B2
(45) Date of Patent: Jan. 11, 2011

(54) SHEET POST-PROCESSING APPARATUS

(75) Inventors: Yasunobu Terao, Izunokuni (JP); Mikio Yamamoto, Izunokuni (JP); Tomomi Iijima, Mishima (JP); Hiroyuki Taki, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 539 days.

(21) Appl. No.: 11/614,138

(22) Filed: Dec. 21, 2006

(65) Prior Publication Data

US 2007/0138728 A1 Jun. 21, 2007

(30) Foreign Application Priority Data

Dec. 21, 2005 (JP) ..... 2005-368277

(51) Int. Cl.
*B65H 37/04* (2006.01)

(52) U.S. Cl. ..... 270/58.11; 270/58.07; 270/58.08; 270/58.09

(58) Field of Classification Search ..... 270/58.07, 270/58.08, 58.09, 58.11
See application file for complete search history.

(56) References Cited

U.S. PATENT DOCUMENTS

| | | | | |
|---|---|---|---|---|
| 6,540,219 | B1 * | 4/2003 | Naruse et al. | 271/37 |
| 6,651,971 | B2 * | 11/2003 | Tsuei | 271/109 |
| 2004/0181308 | A1 * | 9/2004 | Hayashi et al. | 700/223 |
| 2005/0077674 | A1 * | 4/2005 | Yamamoto | 271/265.01 |
| 2005/0218795 | A1 | 10/2005 | Lee et al. | |
| 2006/0066033 | A1 | 3/2006 | Terao et al. | |
| 2006/0066034 | A1 | 3/2006 | Terao et al. | |
| 2006/0066035 | A1 | 3/2006 | Terao et al. | |
| 2006/0066036 | A1 | 3/2006 | Terao et al. | |
| 2006/0066037 | A1 | 3/2006 | Terao et al. | |
| 2006/0066038 | A1 | 3/2006 | Terao et al. | |
| 2006/0066040 | A1 | 3/2006 | Terao et al. | |
| 2006/0066041 | A1 | 3/2006 | Terao et al. | |
| 2006/0067763 | A1 | 3/2006 | Terao et al. | |
| 2006/0067766 | A1 | 3/2006 | Terao et al. | |
| 2006/0067767 | A1 | 3/2006 | Terao et al. | |
| 2006/0067769 | A1 | 3/2006 | Terao et al. | |
| 2006/0067770 | A1 | 3/2006 | Terao et al. | |
| 2006/0067771 | A1 | 3/2006 | Terao et al. | |

(Continued)

FOREIGN PATENT DOCUMENTS

| | | |
|---|---|---|
| JP | 2000-219380 | 8/2000 |

(Continued)

OTHER PUBLICATIONS

Japanese Office Action dated Jan. 19, 2010 corresponding to U.S. Appl. No. 11/614,318, filed Dec. 21, 2006.

*Primary Examiner*—Leslie A Nicholson, III
(74) *Attorney, Agent, or Firm*—Turocy & Watson, LLP

(57) ABSTRACT

A sheet post-processing apparatus includes a pair of sheet feeding rollers for receiving the sheet supplied from an image forming apparatus and conveying it to the downstream side, a stand-by tray for receiving the delivered sheet and an assist arm arranged at the sheet delivery side of the pair of sheet feeding rollers and adapted to turn. The assist arm turns, utilizing the rotary force of a motor that is adapted to rotate both forwardly and backwardly, so as to press the rear end of the sheet delivered from the pair of sheet feeding rollers against the stand-by tray when the motor is driven backwardly.

15 Claims, 15 Drawing Sheets

U.S. PATENT DOCUMENTS

| | | | |
|---|---|---|---|
| 2006/0078363 | A1 | 4/2006 | Terao et al. |
| 2006/0214343 | A1 | 9/2006 | Terao et al. |
| 2006/0214345 | A1 | 9/2006 | Terao et al. |
| 2006/0214346 | A1 | 9/2006 | Terao et al. |
| 2007/0057435 | A1 | 3/2007 | Terao et al. |
| 2007/0057442 | A1 | 3/2007 | Terao et al. |
| 2007/0063410 | A1 | 3/2007 | Terao et al. |
| 2007/0063412 | A1 | 3/2007 | Terao et al. |
| 2007/0063413 | A1 | 3/2007 | Terao et al. |
| 2007/0065204 | A1 | 3/2007 | Terao et al. |
| 2007/0138731 | A1 | 6/2007 | Terao et al. |
| 2007/0147924 | A1 | 6/2007 | Terao et al. |

FOREIGN PATENT DOCUMENTS

| | | | | |
|---|---|---|---|---|
| JP | 2002362825 | | | 12/2002 |
| JP | 2004142868 | A | * | 5/2004 |
| JP | 2004-155551 | | | 6/2004 |
| JP | 2004269249 | | | 9/2004 |
| JP | 2005194092 | | | 7/2005 |

* cited by examiner

SHEET POST-PROCESSING APPARATUS

CROSS-REFERENCE TO RELATED APPLICATION

This application is based upon and claims the benefit of priority from the prior Japanese Patent Application No. 2005-368277, filed on December 21, the entire contents of which are incorporated herein by reference.

BACKGROUND OF THE INVENTION

1. Field of the Invention

This invention relates to a sheet post-processing apparatus for performing a post-processing operation on the sheets of paper delivered from an image forming apparatus such as a copying machine, a printer or a composite machine.

2. Description of the Related Art

Some image forming apparatus that have been marketed in recent years are accompanied by a sheet post-processing apparatus for sorting the sheets carrying an image produced as a result of an image forming operation thereon and/or executing one or more than one post-processing processes such as stapling sheets. Such a post-processing apparatus is normally arranged downstream relative to the image forming apparatus.

A sheet post-processing apparatus for stapling sheets is typically adapted to align a plurality of sheets (a bundle of sheets) by means of an aligning means, staple them, and deliver them onto a delivery tray, where stapled bundles of sheets are laid one on the other.

In such a post-processing apparatus, a succeeding sheet is subjected to a post-processing process only after the completion of the post-processing process of the immediately preceding sheet. Additionally, the post-processing apparatus may or may not be provided with a stand-by tray arranged on the way down to the stapler for the purpose of holding the sheets of paper delivered from the image forming apparatus on a stand-by status.

Meanwhile, arrangements are required to prevent the sheets on the stand-by tray, if partly, from being pushed out by succeeding sheets and neatly align the sheets on the stand-by tray if some of them are curled or in some other unfavorable state.

Jpn. Pat. Appln. Laid-Open Publication No. 2000-219380 describes a sheet delivery apparatus. The described sheet delivery apparatus includes a drawing-in means for drawing a sheet delivered from an image forming apparatus to the sheet delivery apparatus into a tray for post-processing and a delivering means for delivering the sheet that has been subjected to a post-processing process.

Jpn. Pat. Appln. Laid-Open Publication No. 2004-155551 also describes sheet delivery apparatus. The apparatus described in this Patent Document has a specifically devised delivery table in order to neatly lay the discharged sheets discharged on the delivery table one on the other.

However, the above-listed Patent Documents do not pay attention to the poor alignment of sheets that can take place by sheets that are curled or in some other unfavorable state when they get to the apparatus.

In view of the above-identified circumstances, it is therefore an object of the present invention to provide a sheet post-processing apparatus that can improve the alignment of the sheets supplied from an image forming apparatus by regulating them and leading them to the stand-by tray.

DETAILED DESCRIPTION OF THE INVENTION

Throughout this description, the embodiments and examples shown should be considered as exemplars, rather than limitations on the apparatus of the present invention.

Now, a preferred embodiment of the present invention will be described in detail by referring to the accompanying drawings. Throughout the drawings, the same parts are denoted by the same reference symbols and will not be described repeatedly.

Figure 1:
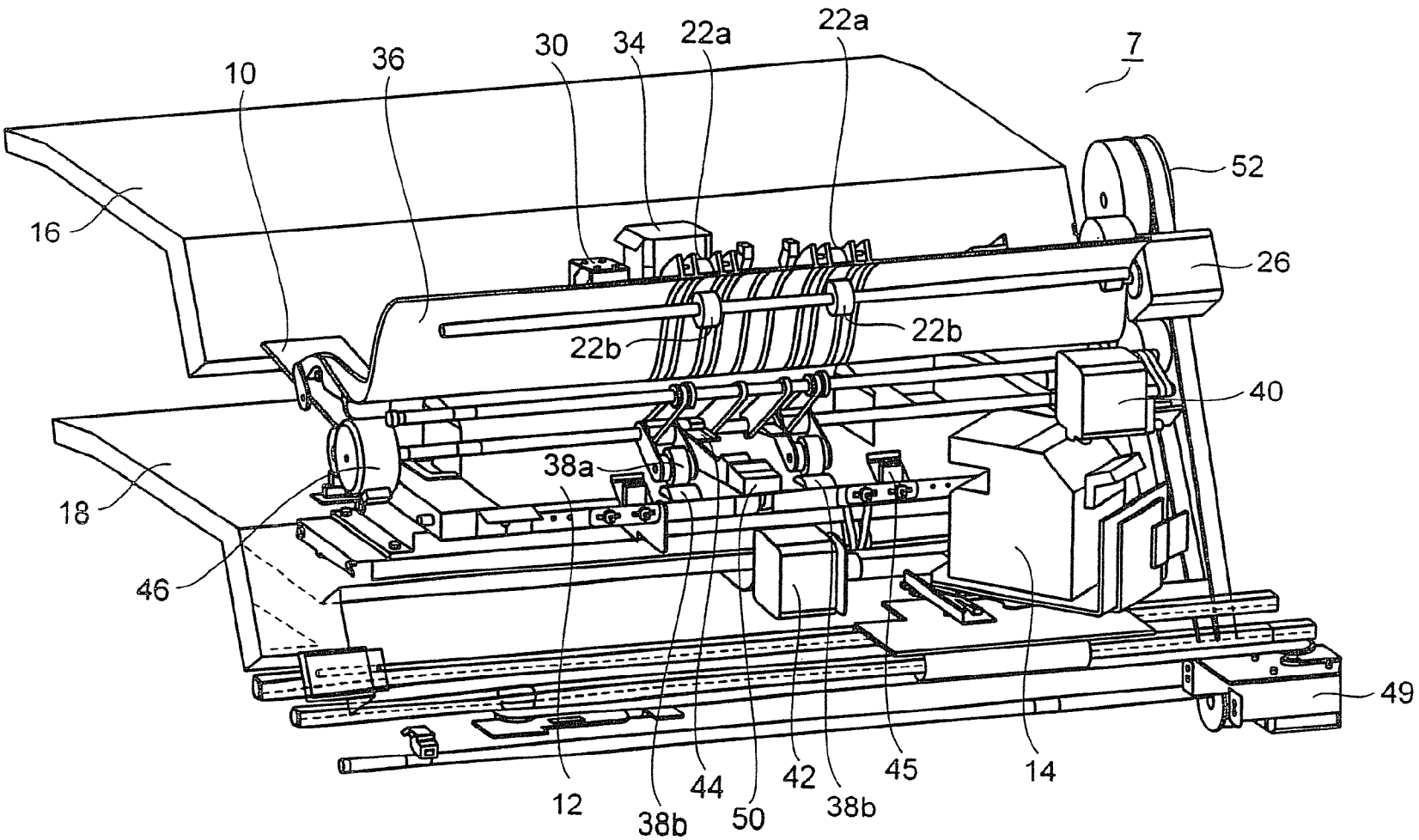
FIG. 1 is a schematic perspective view of an embodiment of sheet post-processing apparatus according to the present invention.
Figure 2:
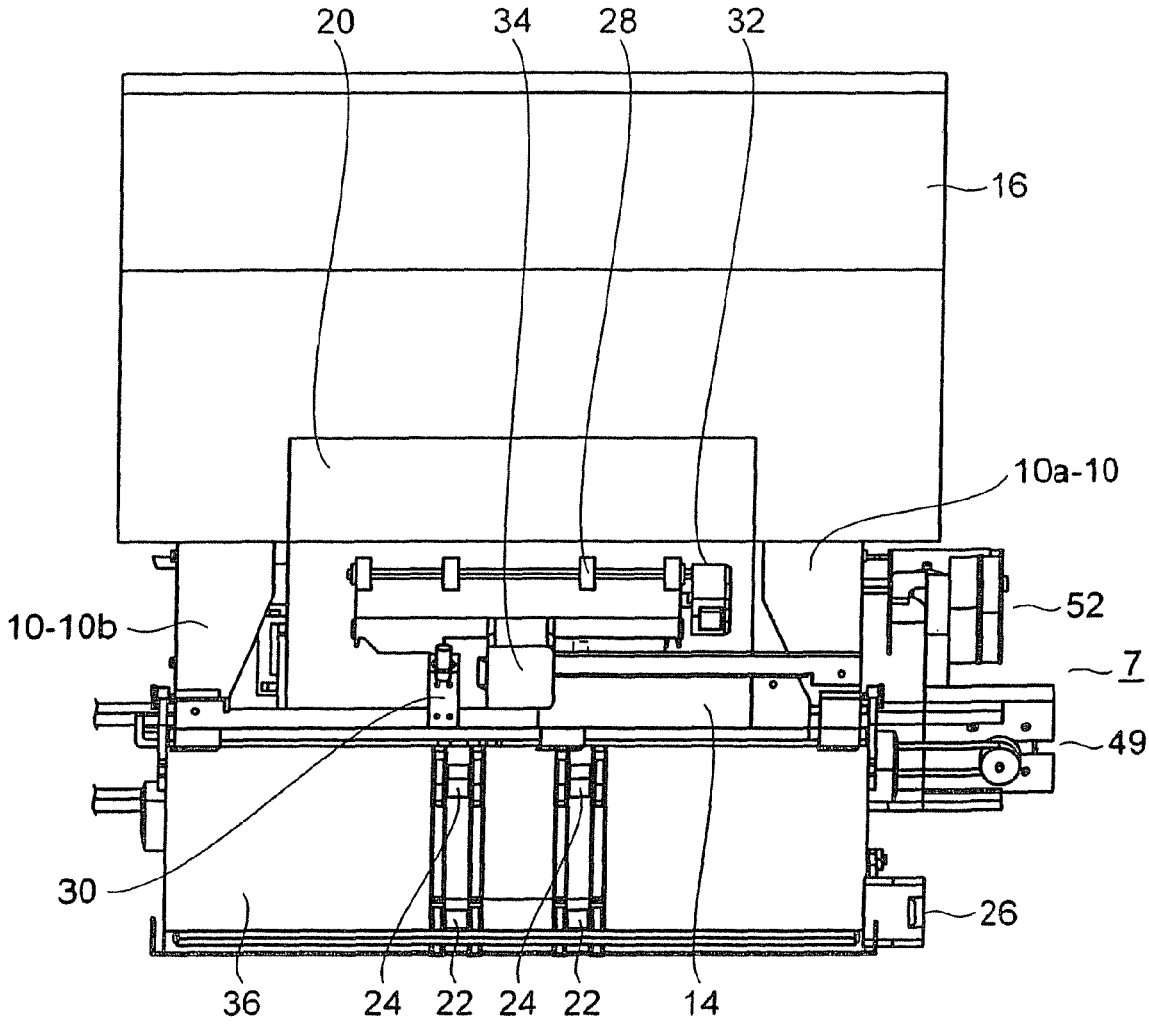
FIG. 2 is a schematic plan view of the sheet post-processing apparatus of FIG. 1.
Figure 3:
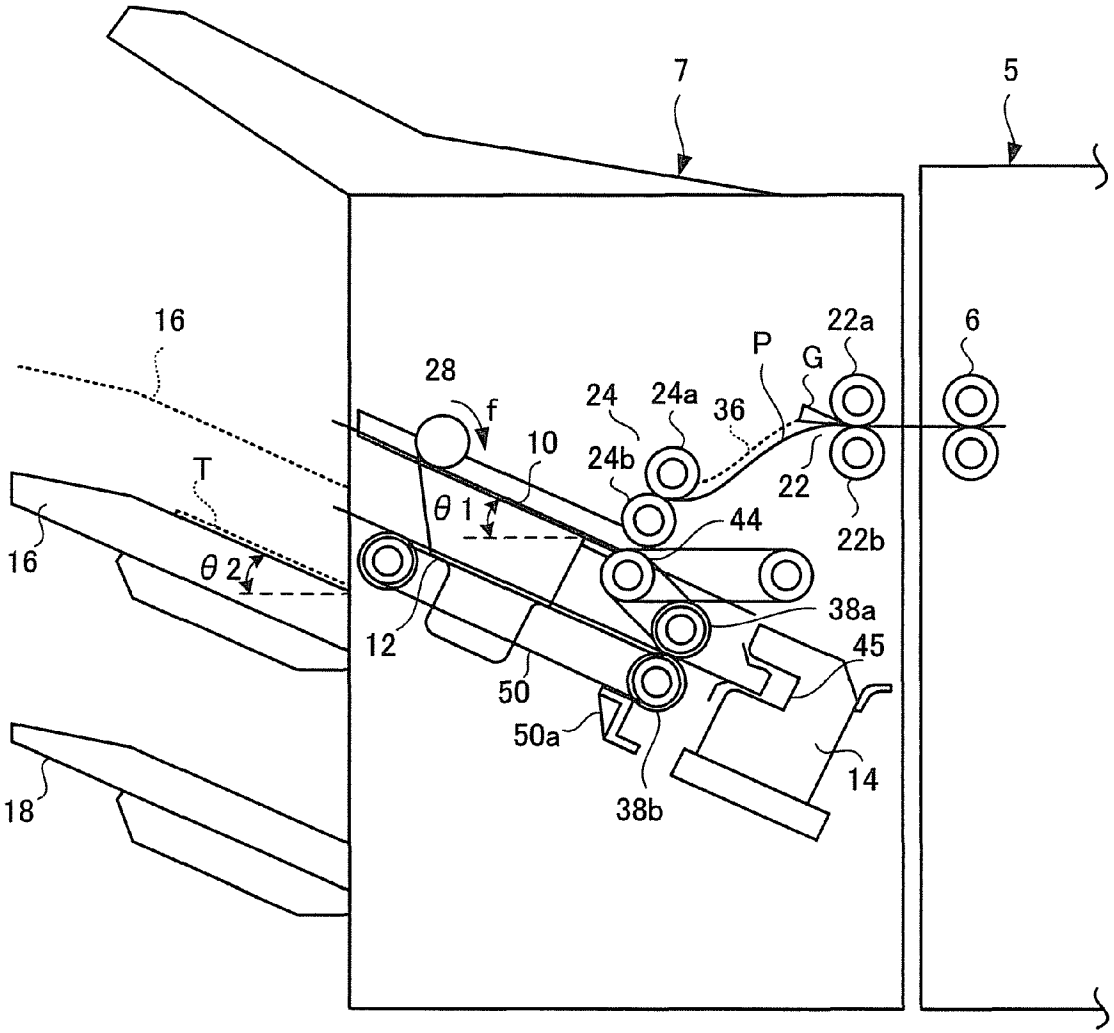
FIG. 3 is a schematic illustration of the configuration of a sheet post-processing apparatus according to the present invention.

FIG. 1 is a schematic perspective view of an embodiment of sheet post-processing apparatus according to the present invention. FIG. 2 is a schematic plan view of the apparatus of FIG. 1. FIG. 3 is a schematic illustration of the configuration of a sheet post-processing apparatus according to the present invention. FIGS. 4 through 11 schematically illustrate different parts of a sheet post-processing apparatus according to the present invention.

The configuration and the operation of each part shown in FIGS. 1 and 2 will be described below by referring to FIG. 4 and the subsequent drawings. Firstly, the processing of a sheet by a sheet post-processing apparatus according to the invention will be described mainly by referring to FIG. 3.

As shown in FIG. 3, sheet P on which an image is formed by an image forming apparatus 5 such as a copying machine is discharged from a pair of delivery rollers 6 and conveyed to the sheet post-processing apparatus 7. The sheet post-processing apparatus 7 includes a stand-by tray 10, a processing tray 12, a stapler 14, a first delivery tray 16, a second delivery tray 18, a gate G and so on.

The sheet P discharged from the pair of delivery rollers 6 of the image forming apparatus 5 is received by an entrance roller pair 22 arranged near the sending-in entrance of the sheet post-processing apparatus 7. The entrance roller pair 22 includes an upper roller 22*a* and a lower roller 22*b*. The entrance roller pair 22 is driven by a motor 26 (FIG. 1).

A gate G is arranged at the downstream side of the entrance roller pair 22. The gate G sorts the sheets P received by the entrance rollers 22 into two paths (flows) The gate G shows a wedge-shaped cross section and the narrow end of the wedge is directed to the entrance rollers 22. The gate G is rotatably supported by a lateral wall section in the sheet post-processing apparatus 7. The gate G is adapted to selectively take a first position where the narrow end thereof is directed to the upper entrance roller 22*a* or a second position where the narrow end thereof is directed to the lower entrance roller 22*b*.

The first position is to be used to select the path for sheets P that require post-processing, whereas the second position is to be used to select the path for sheets P that does not require any post-processing.

When the gate G is at the first position, each sheet P is supplied to the first sheet feeding roller pair 24 and then from the first sheet feeding roller pair 24 to the stand-by tray 10. A paper path ceiling 36 (FIG. 1) is arranged between the entrance rollers 22 to the stand-by tray 10 to guide the sheet P to a first sheet feeding roller pair 24. The first sheet feeding roller pair 24 includes an upper roller 22*a* and a lower roller 22*b*.

The stand-by tray 10 receives a plurality of sheets P and lays them one on the other there until the ongoing processing at the processing tray 12 ends. The processing tray 12 aligns and supports the laid sheets P until the end of the ongoing stapling process at the stapler 14, which is a processing mechanism for post-processing.

Figure 7:
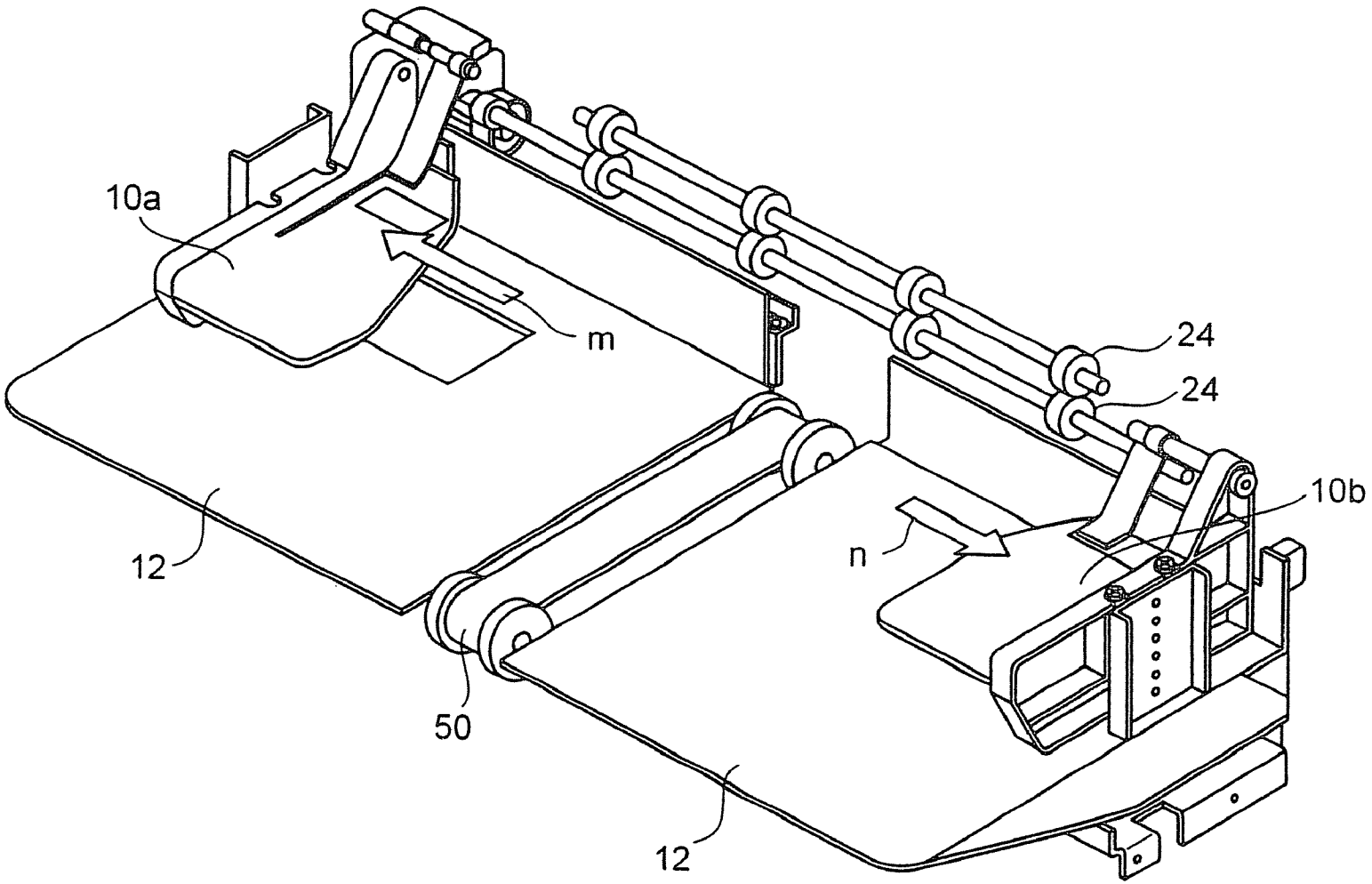
FIG. 7 is a schematic perspective view of the stand-by tray and the processing tray of a sheet post-processing apparatus according to the invention.

As a predetermined number of sheets are stacked in the stand-by tray 10, the tray members 10*a*, 10*b* are opened by a motor 34 (FIG. 1) in respective directions indicated by arrows n and m in FIG. 7. Then, as a result, the sheets P drop into the processing tray 12 by their own weights and fed to the stapler 14.

Figure 4:
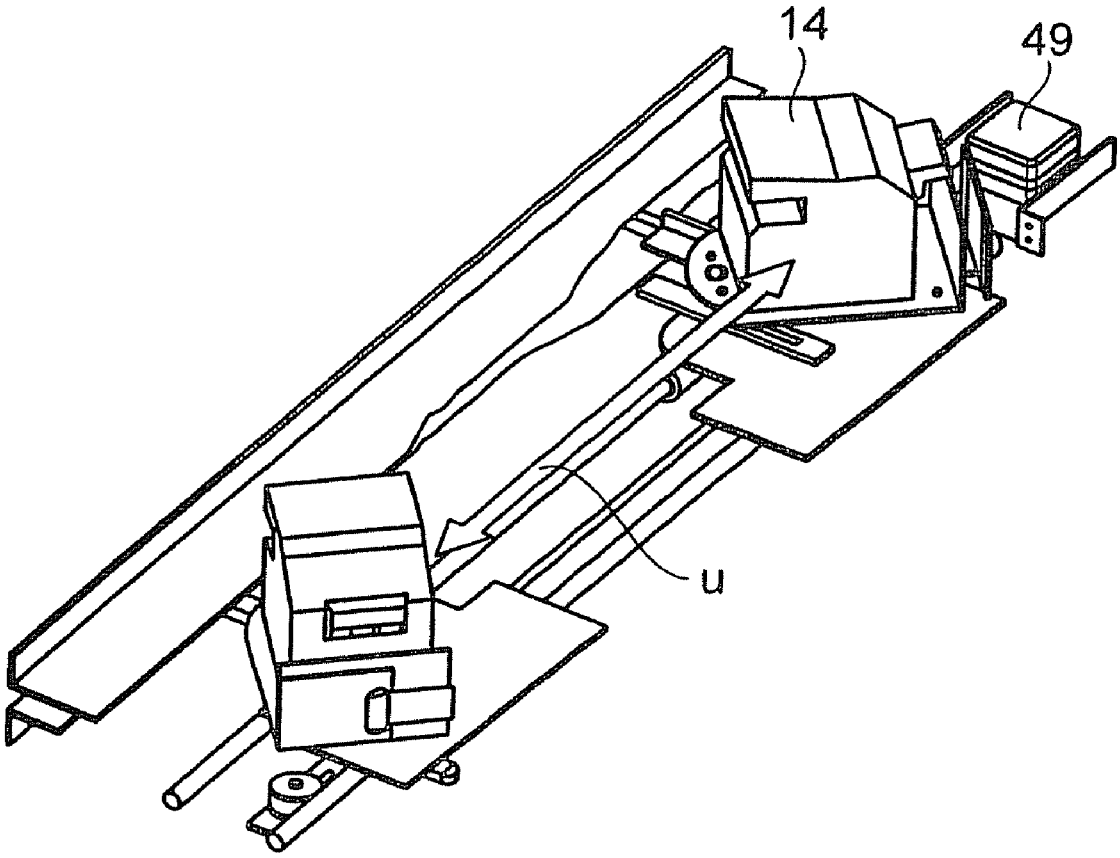
FIG. 4 is a schematic perspective view of the stapler of a sheet post-processing apparatus according to the invention.

As shown in FIG. 4, the stapler 14 is driven to slide in the directions indicated by arrows u by a staple drive section 49 so as to be positioned for a stapling process. While only a single stapler 14 is provided, FIG. 4 shows the stapler before it is driven to slide and after it has been driven.

Figure 5:
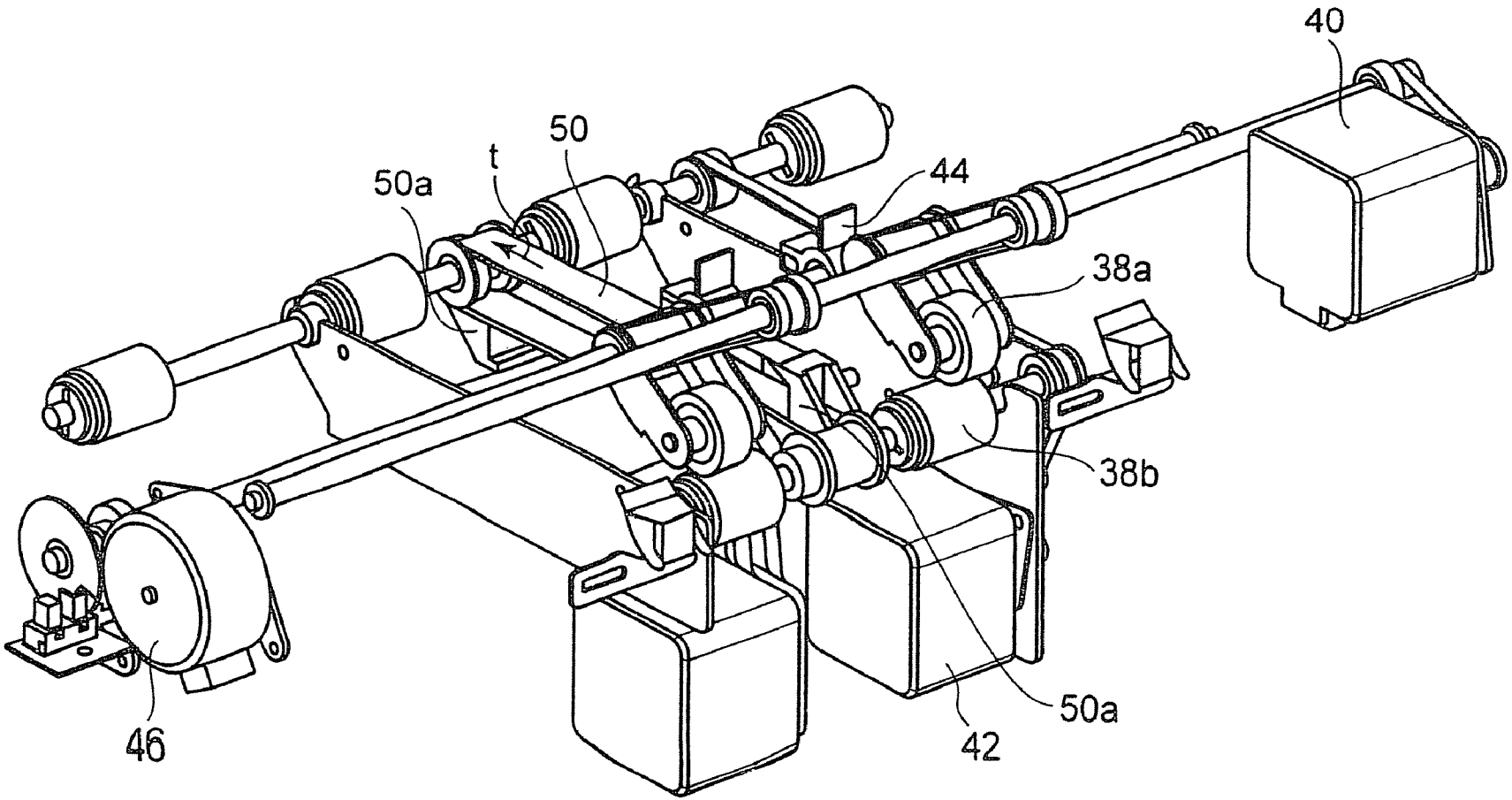
FIG. 5 is a schematic perspective view of the longitudinal alignment roller of a sheet post-processing apparatus according to the invention.
Figure 6:
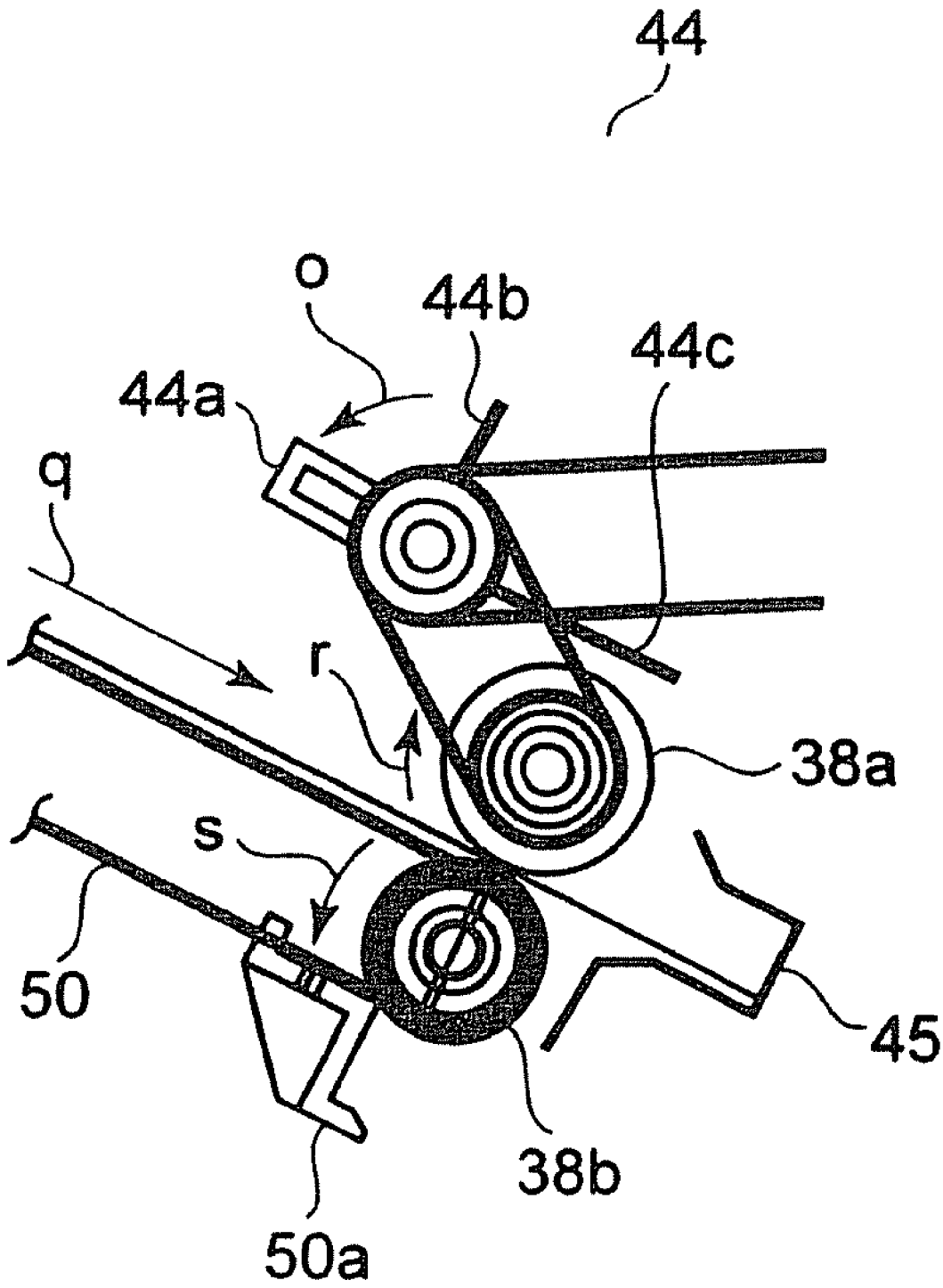
FIG. 6 is a schematic illustration of the paddle of a sheet post-processing apparatus according to the invention.

The processing tray 12 has a pair of longitudinal alignment rollers 38*a*, 38*b* as shown in FIGS. 5 and 6.

The upper and lower longitudinal alignment rollers 38*a*, 38*b* are also used to pinch the stapled bundle of sheets T between them and take it out from the stapler 14 after the stapling process. The longitudinal alignment roller 38*a* is driven by motor 40, whereas the longitudinal alignment roller 38*b* is driven by motor 42.

For the sheets P that falls so as to be supplied to the processing tray 12, a rotatable paddle 44 is arranged at the position where the rear ends of the sheets P are placed. The paddle 44 is adapted to longitudinally align the uppermost sheet P of the sheets that are laid on the processing tray 12.

As shown in FIG. 6, the paddle 44 includes a receiving section 44*a* for receiving the sheets P that enter the stand-by tray 10, a slapping section 44*b* for slapping down the sheets P on the processing tray 12 and a feed section 44*c* for aligning the sheets P on the processing tray 12 and is driven by a paddle motor 46 (FIG. 5). The paddle 44 is made of rubber and hence is elastic.

A stopper 45 is arranged at the end of the processing tray 12 located at the side of the stapler 14 so as to contact the rear ends of the sheets P and regulate the positions of the rear ends. A conveyor belt 50 is arranged substantially at the center of the processing tray 12. The conveyor belt 50 is adapted to convey the bundle of sheets T that has been subjected to a stapling process and taken out from the stapler 14 by the longitudinal alignment rollers 38*a*, 38*b* to either the first delivery tray 16 or the second delivery tray 18. A feed claw 50*a* for hooking the rear end of the bundle of sheets T is fitted to the conveyor belt 50.

While the stand-by tray 10 can fall and supply sheets P to the processing tray 12, it can also be used to convey sheets P either toward the first delivery tray 16 or toward the second delivery tray 18. More specifically, when sheets P are conveyed toward the delivery tray 16 or toward the delivery tray 18, the rotary roller pair 28 for aligning sheets P is brought into contact with the sheets P laid on the stand-by tray 10. The rotary roller pair 28 is controlled for its vertical movement by a drive source 30 and driven to rotate by a motor 32 (FIG. 2).

As shown in FIG. 3, the stand-by tray 10 is so arranged as to show an angle of inclination θ1 so as to support sheets P in a condition where the front ends of the sheets P are found above the respective rear ends thereof. The first delivery tray 16 or the second delivery tray 18 is selected and driven to move up and down by a drive section 52.

Thus, when receiving sheets P, the first delivery tray 16 or the second delivery tray 18 that is selected is raised or lowered substantially to the height of the processing tray 12 to align the sheets P discharged onto it better. The first delivery tray 16 or the second delivery tray 18 that is selected is so arranged as to show an angle of inclination θ2 so as to support sheets P in a condition where the front ends of the sheets P are found above the respective rear ends thereof.

Figure 8:
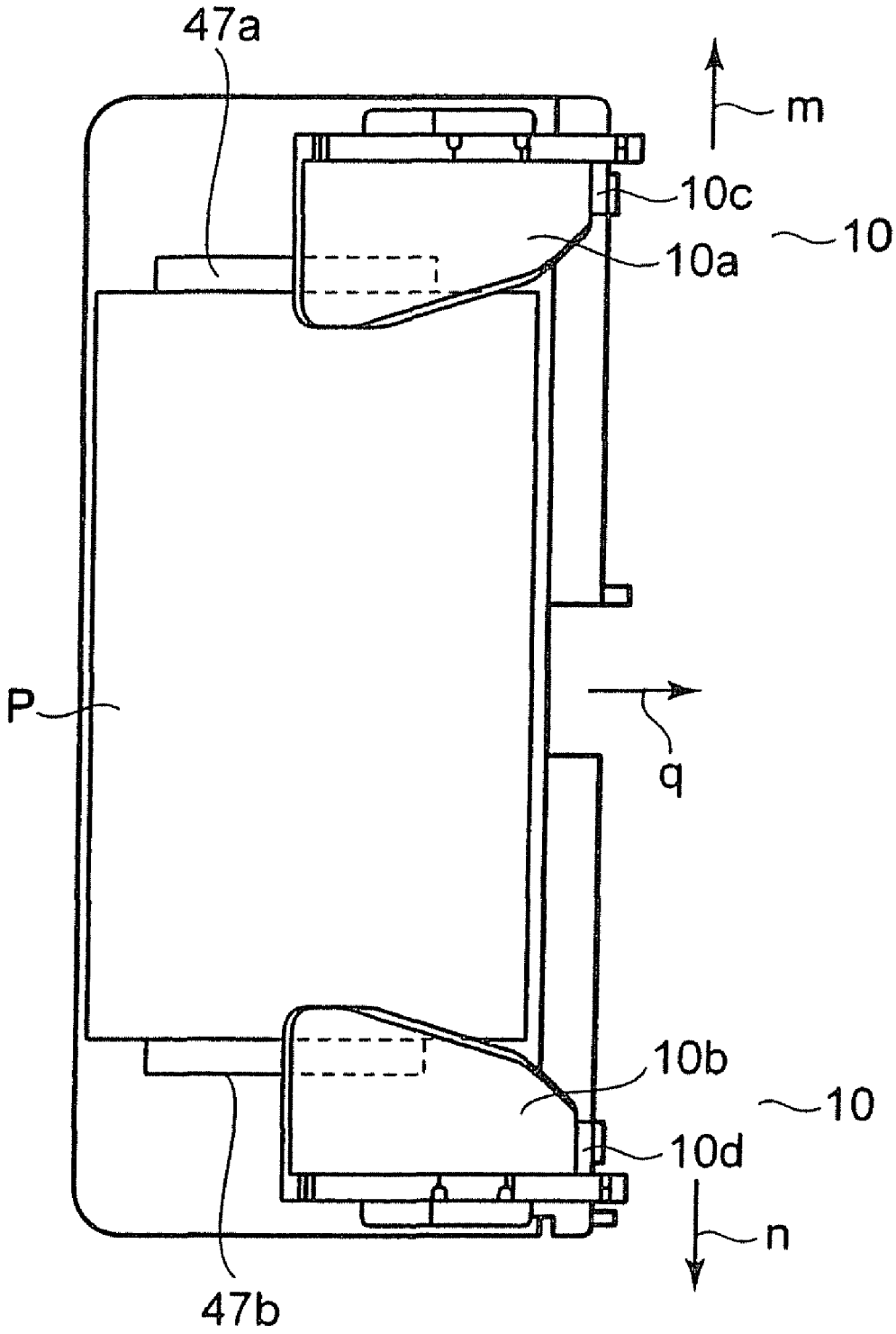
FIG. 8 is a schematic plan view of the stand-by tray and the processing tray of a sheet post-processing apparatus according to the invention.

As shown in FIGS. 7 and 8, the stand-by tray 10 is provided with a pair of tray members 10*a*, 10*b* that are formed to project from the wall surface thereof and adapted to slide sideways to receive sheets P and support them at the corresponding opposite ends thereof. The tray members 10*a*, 10*b* are provided respectively with stoppers 10*c*, 10*d* for regulating the rear ends of the received sheets P.

Figure 9:
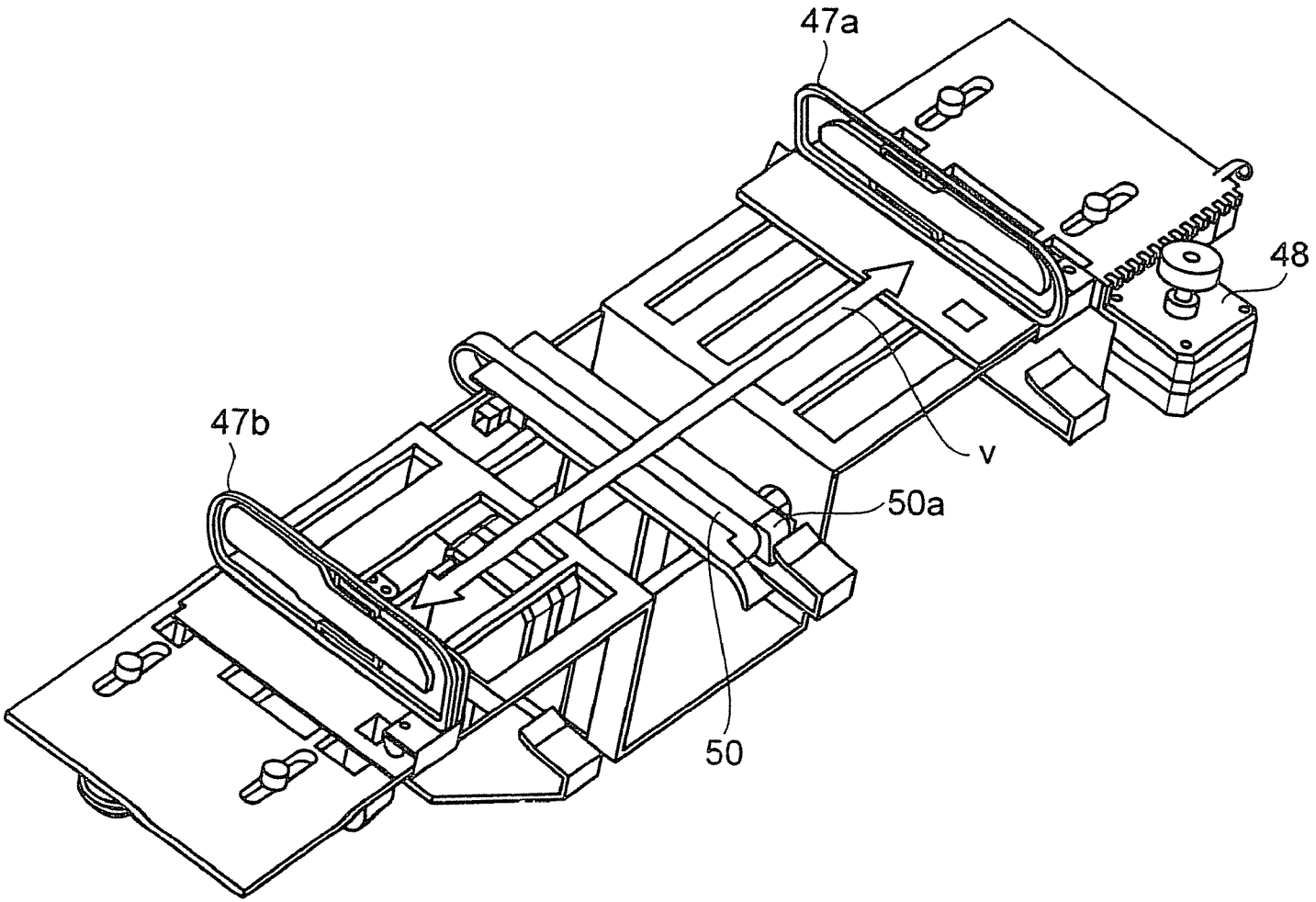
FIG. 9 is a schematic perspective view of the transversal alignment plate and the conveyor belt of a sheet post-processing apparatus according to the invention.

The stand-by tray 10 is driven to slide by a motor 34 (FIG. 2). A pair of transversal alignment plates 47*a*, 47*b* is arranged between the stand-by tray 10 and the processing tray 12 as shown in FIG. 9 in order to prevent the sheets P fallen from the stand-by tray 10 and supplied to the processing tray 12 from being disordered in the transversal direction that is orthogonal to the sheet conveying direction and transversally align them. The transversal alignment plates 47*a*, 47*b* can be driven to slide in the directions indicated by arrow v so as to make the gap between them match the width of the sheets P. In other words, their alignment positions can be shifted.

The motors 26, 32, 34, 40, 42, 46 and 48 for driving the above-described various mechanisms and the drive sections 49 and 52 are driven and controlled by a control circuit (not shown).

Now, the operation of the sheet post-processing apparatus 7 will be described in terms of the flow of sheets. As a sheet P on which an image is formed by the image forming apparatus 5 is supplied form the delivery roller pair 6, the sheet post-processing apparatus 7 operates differently depending on (1) when the sheet P is not to be subjected to post-processing, (2) when the sheet P is to be subjected to post-processing and the post-processing of the preceding sheet P has been completed and (3) when the sheet P is to be subjected to post-processing and the post-processing of the preceding sheet P is in progress.

Firstly, (1) when the sheet P is not to be subjected to post-processing, the first delivery tray 16 is driven to slide to the position indicated by the dotted line in FIG. 3 so as to be ready to receive the sheet P delivered from the stand-by tray 10 in a well-aligned manner.

When the sheet P is not to be subjected to post-processing, the sheet P conveyed from the entrance roller pair 22 to the sheet feeding roller pair 24 by way of the paper path ceiling 36 is supplied to the stand-by tray 10 by the sheet feeding roller pair 24. Then, the sheet P is lowered onto the stand-by tray 10 and conveyed by the rotary roller pair 28 that is driven to rotate in the direction of arrow f in FIG. 3 and delivered to the first delivery tray 16.

Now, (2) when the sheet P is to be subjected to post-processing (a stapling process) and there is no preceding sheet P on the processing tray 12, the stand-by tray 10 is driven to slide in the direction of arrow m or arrow n to either of the positions indicated by dotted lines, where it drops the sheet P. The transversal alignment plates 47*a*, 47*b* are arranged so as to show a gap between them substantially equal to the width of the sheet P in order to transversally align the dropping sheet P. Then, as a result, the sheet P supplied by the sheet feeding roller pair 24 is directly dropped onto the processing tray 12 without being obstructed by the stand-by tray 10 on the way.

When the sheet P is dropped, the longitudinal alignment roller pair 38*a* is retreated upwardly and the receiving section 44*a* of the paddle 44 receives the sheet P at the rear end of the sheet P. The sheet P falls as its two lateral sides are guided by the transversal alignment plates 47*a*, 47*b* so as to be aligned in the transversal direction. Thereafter, the paddle 44 is driven to rotate in the sense as indicated by arrow o in FIG. 6 in order to drop the sheet P from its receiving section 44*a* from the rear end of the sheet P and slaps it down onto the processing tray 12 by means of its slapping section 44*b*.

Additionally, the paddle 44 sends out the sheet P in the direction of arrow q by means of its feed section 44*c* until the rear end of the sheet P contacts the stopper 45 to complete the operation of longitudinally aligning the sheet P. Note that the longitudinal alignment roller 38*a* may be driven to move up and down each time a sheet P is delivered to it in order to perform the operation of longitudinally aligning the sheet P on the processing tray 12.

Thus, the sheet P on which an image is formed is directly laid on the processing tray 12 from the sheet feeding roller pair 24 while it is sequentially aligned transversally and longitudinally. As the number of sheets P on the processing tray 12 gets to a predetermined level, the sheets P on the processing tray 12 is stapled by the stapler 14 at one or more than one desired positions to form a bundle of sheets T.

Thereafter, the bundle of sheets T is pinched by the longitudinal alignment roller 38*a* that is driven to rotate in the sense of arrow r and the longitudinal alignment roller 38*b* that is driven to rotate in the sense of arrow s in FIG. 6 and conveyed toward the first delivery tray 16.

As the rear end of the bundle of sheets T passes the longitudinal alignment rollers 38*a*, 38*b*, it is hooked by the feed claw 50*a* of the conveyor belt 50 that is driven to rotate in the sense of arrow t in FIG. 5 and put on the first delivery tray 16. At this time, the first delivery tray 16 is driven to slide from the position indicated by a dotted line to the position indicated by a solid line in FIG. 3.

Since the first delivery tray 16 is arranged with an angle of inclination θ2 and hence the front ends of the sheets P are found above the respective rear ends thereof, the preceding sheet P delivered onto the first delivery tray 16 would not be pushed out if the rear end of the preceding sheet P touches the front end of the succeeding bundle of sheets T.

If the sheets of the preceding bundle of sheets T are misaligned by the succeeding sheet P, the bundle of sheets T falls by its own weight and hence is laid on the first delivery tray 16 with the rear ends of the sheets aligned with each other because of the angle of inclination θ2. In other words, the delivered sheets P are sequentially laid on the first delivery tray 16 in the proper order to complete the process of stapling the sheets P.

Thus, sheets are sequentially laid on the first delivery tray 16 in the above-described manner. As pointed out above, the first delivery tray 16 is made to show an angle of inclination of θ2 and hence the front ends of the sheets P on it are found above the respective rear ends thereof. Therefore, if a sheet P is curled to raise a middle part from the other parts thereof when delivered onto the first delivery tray 16 and its front end touches the preceding sheet P laid on the first delivery tray 16, the preceding sheet P would not be pushed out by the succeeding curled sheet P. In other words, the delivered sheets P are sequentially laid on the first delivery tray 16 in the proper order.

Finally, the instance (3) when the sheet P is to be subjected to post-processing and there are preceding sheets P remaining on the processing tray 12 because the stapling process that is being executed on them has been completed will be described below.

Figure 11:
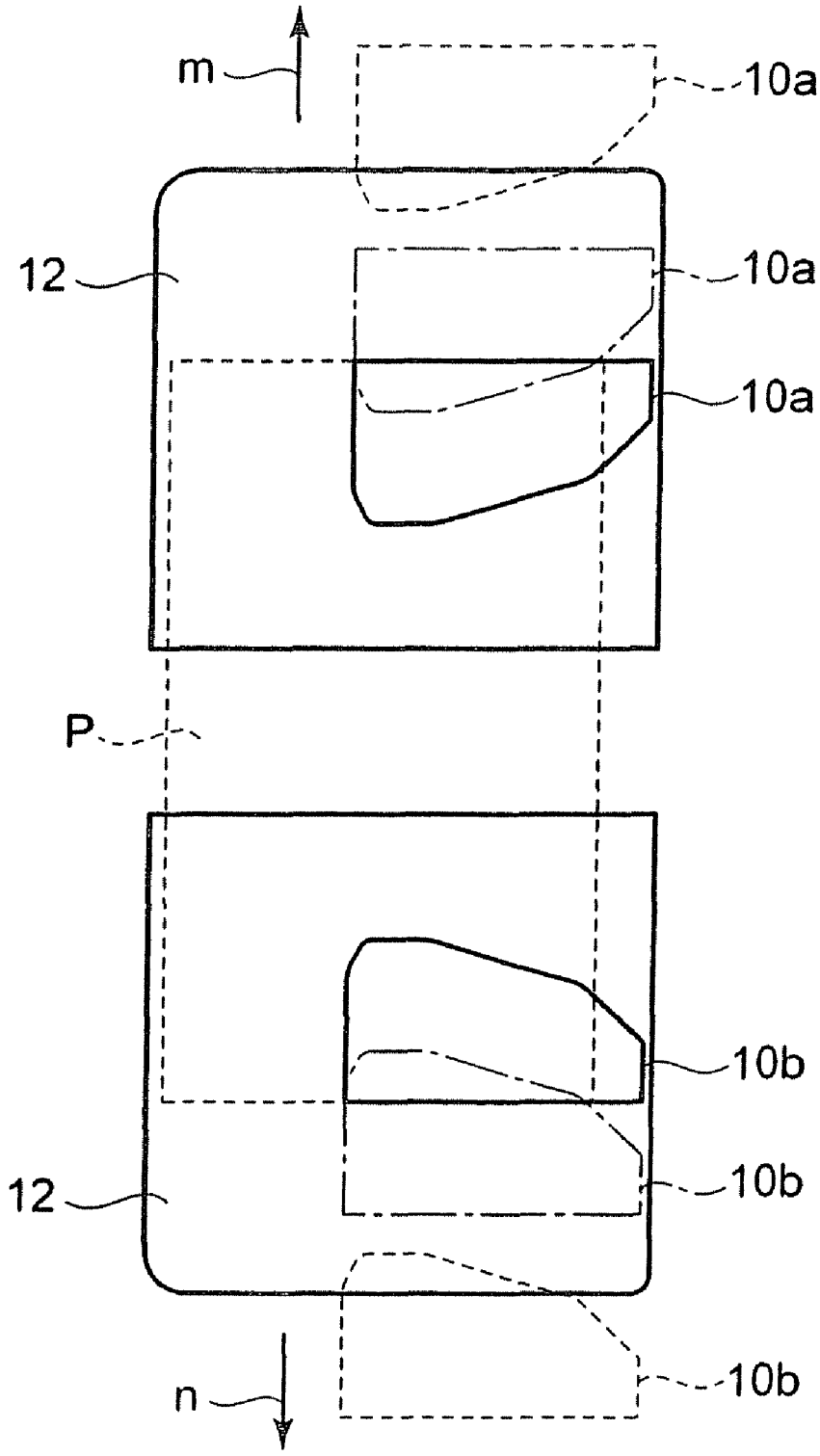
FIG. 11 is a schematic illustration of the movement of the stand-by tray of a sheet post-processing apparatus according to the invention.

In this condition, the tray members 10*a*, 10*b* are driven to slide respectively from the positions indicated by dotted lines in the directions opposite to arrows m and n to get to the positions indicated by solid lines in FIG. 11 so that they can support sheets P. Additionally, the rotary roller pair 28 is retreated above the stand-by tray 10 so as not to obstruct the sheets P. Thus, the sheet P discharged from the image forming apparatus 5 and delivered by the sheet feeding roller pair 24 is temporarily laid on the stand-by tray 10 until the processing tray 12 becomes ready for receiving it.

The second and subsequent sheets P laid on the stand-by tray 10 fall onto the stand-by tray 10 and then are sent toward the stoppers 10*c*, 10*d* by the rotary roller pair 28 that is driven to rotate in the sense opposite to that of arrow f in FIG. 3 until the rear ends of the sheets P contact the stoppers 10*c*, 10*d* so as to be longitudinally aligned. Additionally, the stand-by tray 10 is arranged to show an angle of inclination of θ1 so that the front ends of the sheets P on the stand-by tray 10 are found above the respective rear ends thereof. Thus, the sheets P are made to contact the stoppers 10*c*, 10*d* by their own weights and hence longitudinally aligned.

In this way, the supplied sheets P are sequentially laid on the stand-by tray 10 in the proper order. If a preceding sheet P is pushed by a succeeding sheet P and slightly misaligned, the preceding sheet P falls to the position where its rear end contacts the stoppers 10*c*, 10*d* because of the angle of inclination θ1. Thus, the rear ends of the sheets P that are laid on the stand-by tray 10 are held to an aligned state.

Meanwhile, as the preceding sheets P on the processing tray 12 are discharged toward the first delivery tray 16 and the processing tray 12 is ready for receiving the succeeding sheets P, the tray members 10*a*, 10*b* of the stand-by tray 10 are driven to slide respectively in the direction of arrow m and the direction of arrow n from their positions indicated by solid lines to the positions indicated by dotted lines by way of the positions indicated by dotted chain lines in FIG. 11.

Then, as the tray members 10*a*, 10*b* get to the respective positions indicated by dotted chain lines in FIG. 11, the sheets P, e.g., two sheets P, that are on a stand-by status on the stand-by tray 10 are made to fall onto the processing tray 12 between the tray members 10*a*, 10*b*. At this time, the gap separating the transversal alignment plates 47*a*, 47*b* is made to be substantially equal to the width of the sheets P. Thus, the sheets P that are made to fall from the stand-by tray 10 are restricted at the lateral sides thereof and transversally aligned by the transversal alignment plates 47*a*, 47*b*.

The lower sheet P of the two sheets that are made to fall on the processing tray 12 is sent in the direction of arrow q by the longitudinal alignment roller 38*b* that is driven to rotate in the sense opposite to that of arrow s in FIG. 6 so as to contact the stopper 45 at the rear end of thereof to complete the operation of aligning the sheet P in the longitudinal direction.

On the other hand, the upper sheet P of the two sheets that are made to fall on the processing tray 12 is sent in the direction of arrow q by the longitudinal alignment roller 38*a* that is driven to rotate in the sense opposite to that of arrow r in FIG. 6 so as to contact the stopper 45 at the rear end thereof to complete the operation of aligning the sheet P in the longitudinal direction. Thereafter, the longitudinal alignment roller 38*a* is retreated upwardly.

Then, the third and subsequent sheets P discharged from the image forming apparatus 5 are made to fall directly from between the tray members 10*a*, 10*b* to the processing tray 12 without held to a stand-by status on the stand-by tray 10. The third and subsequent sheets P are sequentially aligned on the sheets P that have been laid on the processing tray 12 by the paddle 44.

Figure 10:
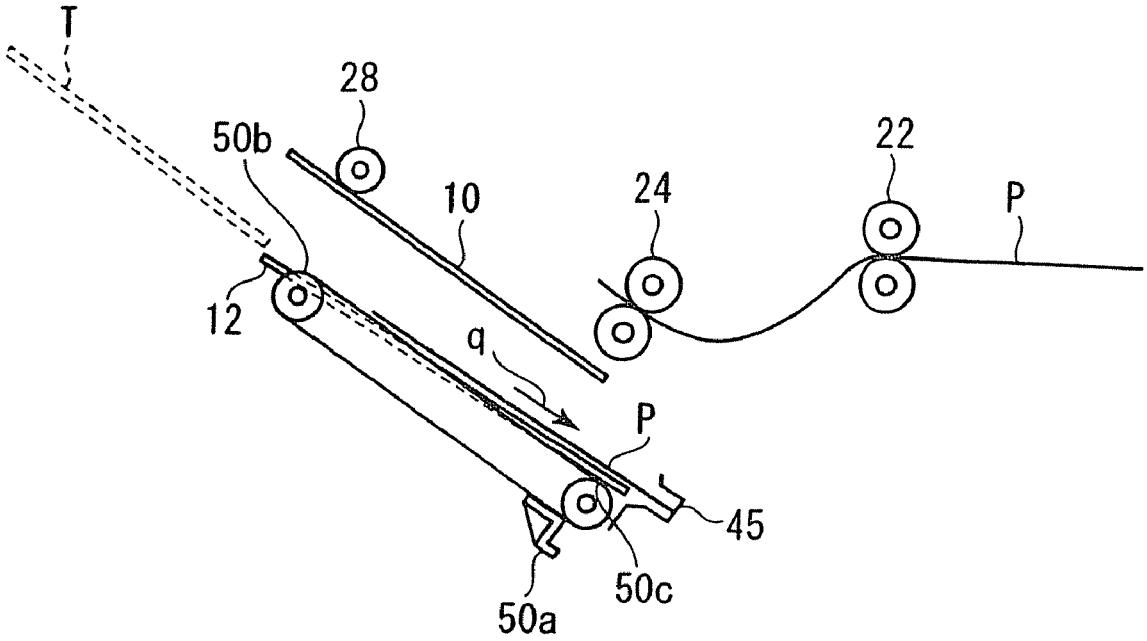
FIG. 10 is a schematic illustration of the sheet delivery operation of a sheet laid on the processing tray of a sheet post-processing apparatus according to the invention.

When the number of sheets P laid on the processing tray 12 gets to a predetermined level, a bundle of sheets T is formed by the stapler 14 by way of a stapling process. Thereafter, the bundle of sheets T is conveyed toward the first delivery tray 16 by the longitudinal alignment rollers 38*a*, 38*b* and hooked by the feed claw 50*a* of the conveyor belt 50 at the rear end thereof so as to be put on the first delivery tray 16 as shown in FIG. 10 to complete the stapling process of the sheets P.

The overall operation of the sheet post-processing apparatus 7 is described above. Now, the configuration of a sheet feeding part of the stand-by tray 10 that characterized the present invention will be described below.

As pointed out above, a plurality of sheets P are temporarily laid on the stand-by tray 10 before being led to the processing tray 12 until the ongoing processing is completed at the processing tray 12 of the sheet post-processing apparatus 7. Then, it is necessary to prevent the sheets P laid on the stand-by tray 10 from being pushed out by the succeeding sheets that are conveyed to the stand-by tray 10. Additionally, if any of the sheets P is curled, there can arise a problem where the paddle 44 is driven idly.

Figure 12:
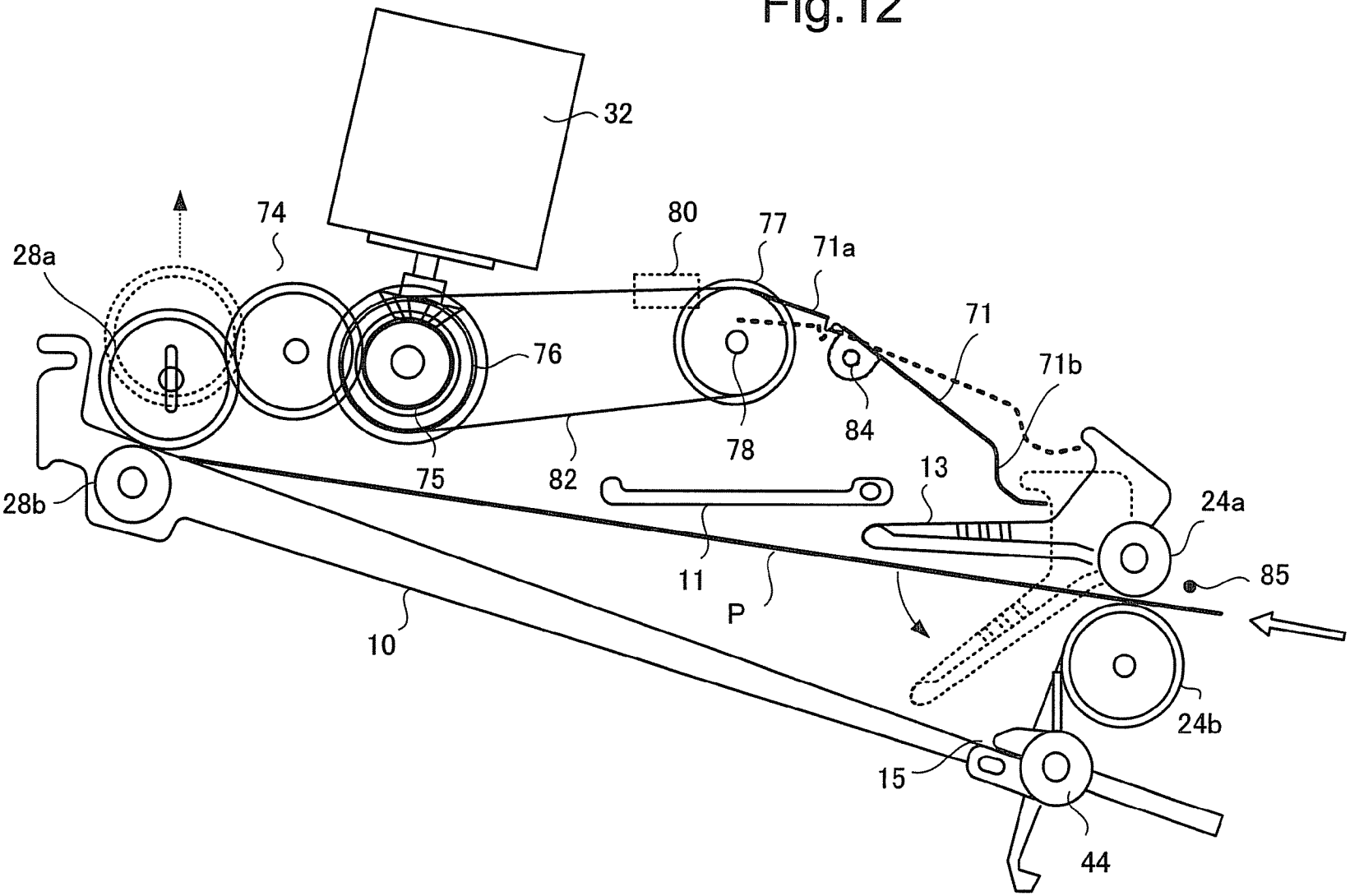
FIG. 12 is a schematic illustration of the stand-by tray guide pair and the assist arm that are principal parts of a sheet post-processing apparatus according to the invention.
Figure 13:
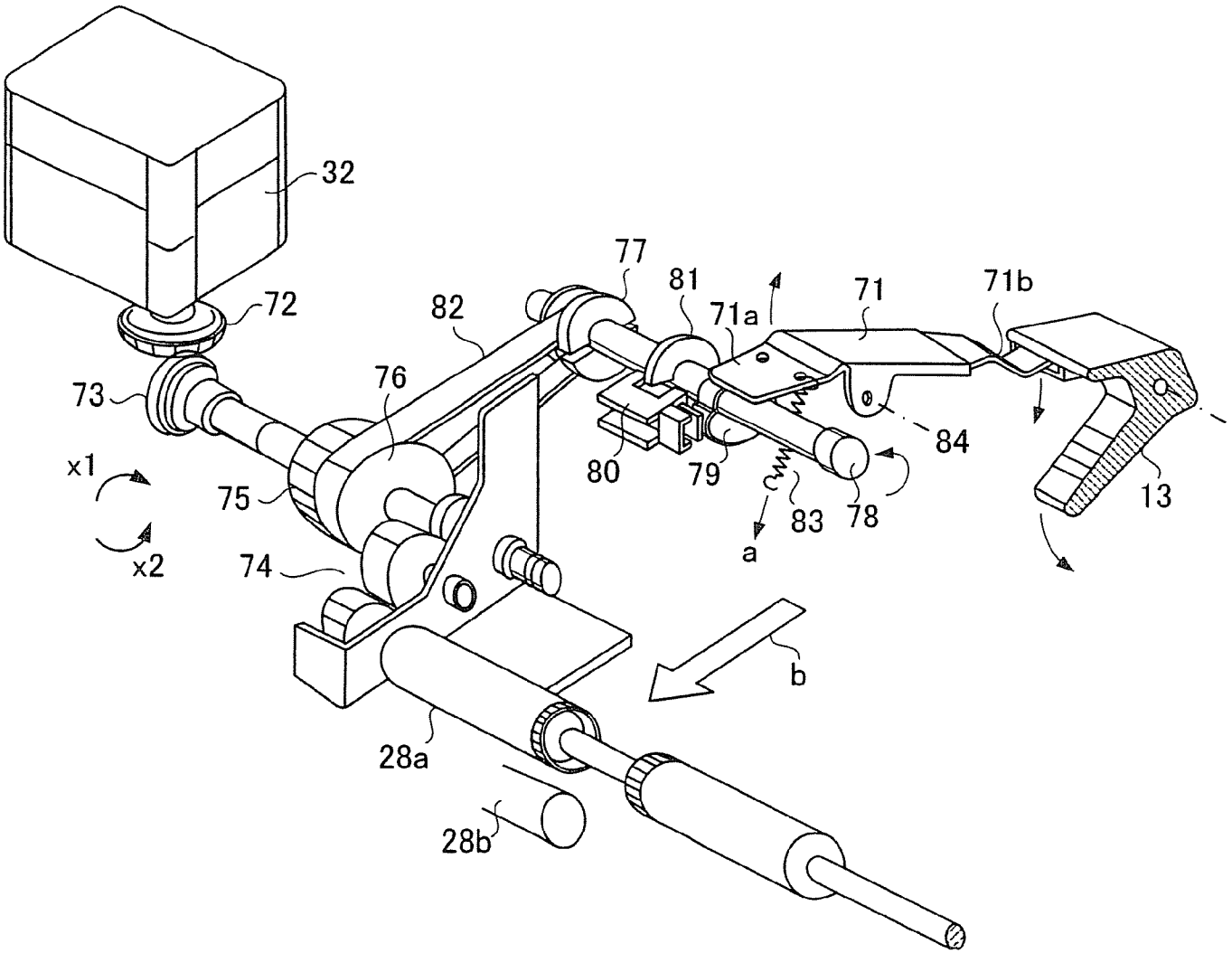
FIG. 13 is a schematic perspective view of the drive system of the assist arm of a sheet post-processing apparatus according to the invention.

Thus, according to the present invention, the sheet feeding part as shown in FIGS. 12 and 13 is devised in a specific way.

Each sheet P is conveyed to the stand-by tray 10 by way of the sheet feeding roller pair 24 and a stand-by tray guide pair 11 is arranged at the rear end side of the sheet P. The stand-by tray guide pair 11 is adapted to regulate the movement and the attitude of the sheet P being fed from the paper feeding roller pair 24 to the stand-by tray 10.

Generally, when an image is printed on one of the opposite surfaces of a sheet P, the ink contracts and hence the sheet P is curled upward when the printed surface is made to face down. The stand-by tray guide pair 11 is supported at a lateral side of the stand-by tray 10 so as to be able to swing and the front end thereof is rounded to crush down the curled sheet P.

Additionally, the assist arm 13 is supported to the shaft of the sheet feeding roller 24*a* so as to be able to swing. The assist arm 13 projects toward the delivery side of the sheet feeding roller 24*a*. It is adapted to push the rear end of the sheet P that is being conveyed at high speed against the stand-by tray 10 and prevent it from being lifted up. The assist arm 13 is driven to turn by a lever 71.

The motor 32 for driving the rotary roller pair 28 is also used to drive the lever 71. The rotary roller pair 28 is arranged downstream relative to the sheet feeding roller pair 24 along the moving direction of the sheet discharged from the latter so as to forward the sheet P to the first or second delivery tray 16 or 18. According to the present invention, the drive motor 32 for driving the rotary roller pair 28 is used to actively turn the assist arm 13.

The motor 32 has a bevel gear 72 at the front end of its rotary shaft. As the bevel gear 72 rotates, the rotary roller pair 28 is driven to rotate by way of a gear 73 and a gear train 74. The rotary motion of the bevel gear 72 is transmitted to a drive pulley 76 by way of a one-way clutch 75. The one-way clutch 75 transmits the rotary motion of the motor 32 to the drive pulley 76 only when the motor 32 that can rotate both forwardly and backwardly rotates in one way. The drive pulley 76 is linked to the drive pulley 77 by way of a drive belt 82. The drive shaft 78 of the drive pulley 77 is adapted to rotate when the motor 32 rotates backwardly so as to turn the lever 71 at an end 71*a* thereof by way of the rotary motion of the cam 79 arranged on the rotary shaft 78.

A cam sensor 80 is provided to detect the rotary motion of the cam 79. The cam sensor 80 includes a light emitting section and a light receiving section (not shown) A light shielding plate 81 is fitted to the rotary shaft 78 to block the light path of the cam sensor 80. The light shielding plate 81 is notched so that light emitted from the light emitting section is detected by the light receiving section by way of the notch.

The cam 79 is an eccentric cam. As the cam 79 is driven to rotate, it moves from a position (home position) where it lifts up an end 71*a* of the lever 71 to a position where it lowers the end 71*a*. The cam sensor 80 detects the cam 79 when the latter is at the home position. The end 71*a* of the lever 71 is urged in the direction of arrow a in FIG. 13 by means of a spring 83 and the like. As the lever 71 is turned around its fulcrum 84, its other end 71*b* drives the assist arm 13 to move.

The rotary roller pair 28 includes an upper rotary roller 28*a* and a lower rotary roller 28*b* and is adapted to pinch a sheet P between the rotary rollers 28*a*, 28*b* and convey the sheet P in the direction of arrow b in FIG. 13. When the rotary roller pair 28 conveys a second sheet P, the rotary roller 28*a* is moved upward so as not to contact the rotary roller 28*b*. Then, the second sheet P is led onto the stand-by tray 10 by the conveying force of the sheet feeding roller pair 24.

A sensor 85 is arranged near the sheet feeding roller pair 24 to detect the condition of the sheet P being conveyed. Thus, the rotary roller 28*a* is moved upward as the sensor 85 detects that the rear end of the sheet P passes the sheet feeding roller pair 24. The motor 32 is driven to rotate backwardly when the rotary roller 28*a* is moved upward. In FIG. 13, the direction of forward rotation is indicated by x1, while the direction of backward rotation is indicated by x2.

Figure 14:
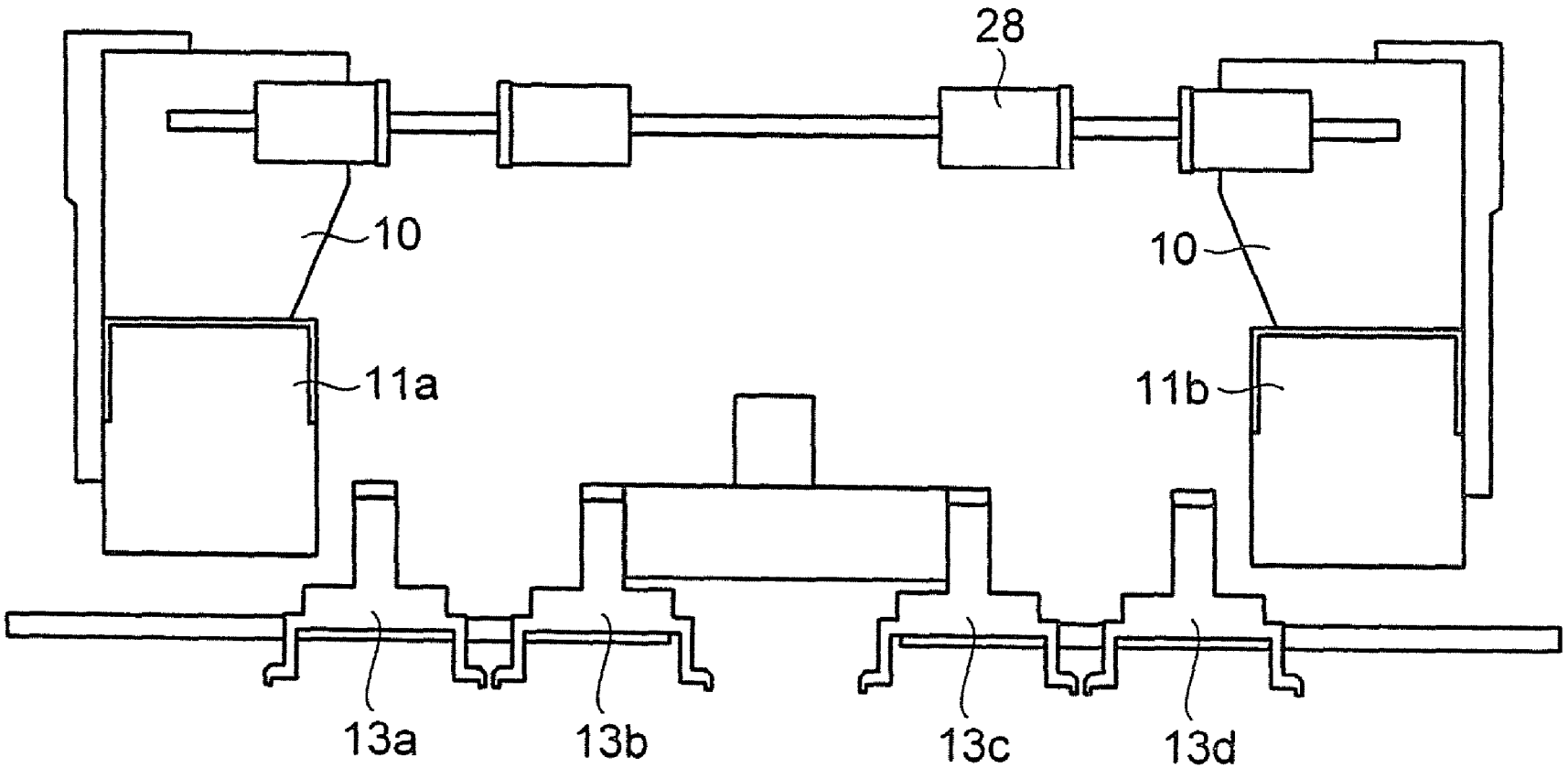
FIG. 14 is a schematic illustration of a typical arrangement of the stand-by tray guide pair and the assist arm of a sheet post-processing apparatus according to the invention.

FIG. 14 is a plan view of the stand-by tray guide pair 11 and the assist arm 13, showing the configuration thereof. The stand-by tray guide pair 11 includes a left stand-by tray guide 11*a* and a right stand-by tray guide 11*b* with a gap separating them from each other that can be adjusted according to the width of the sheet P being conveyed. The assist arm 13 is arranged between the pair of stand-by tray guides 11*a*, 11*b* and typically includes four arms 13*a*, 13*b*, 13*c*, 13*d*. Adjacent ones of the arms 13*a* through 13*d* may be linked so as to make them operate in an interlocked manner.

Figure 15A:
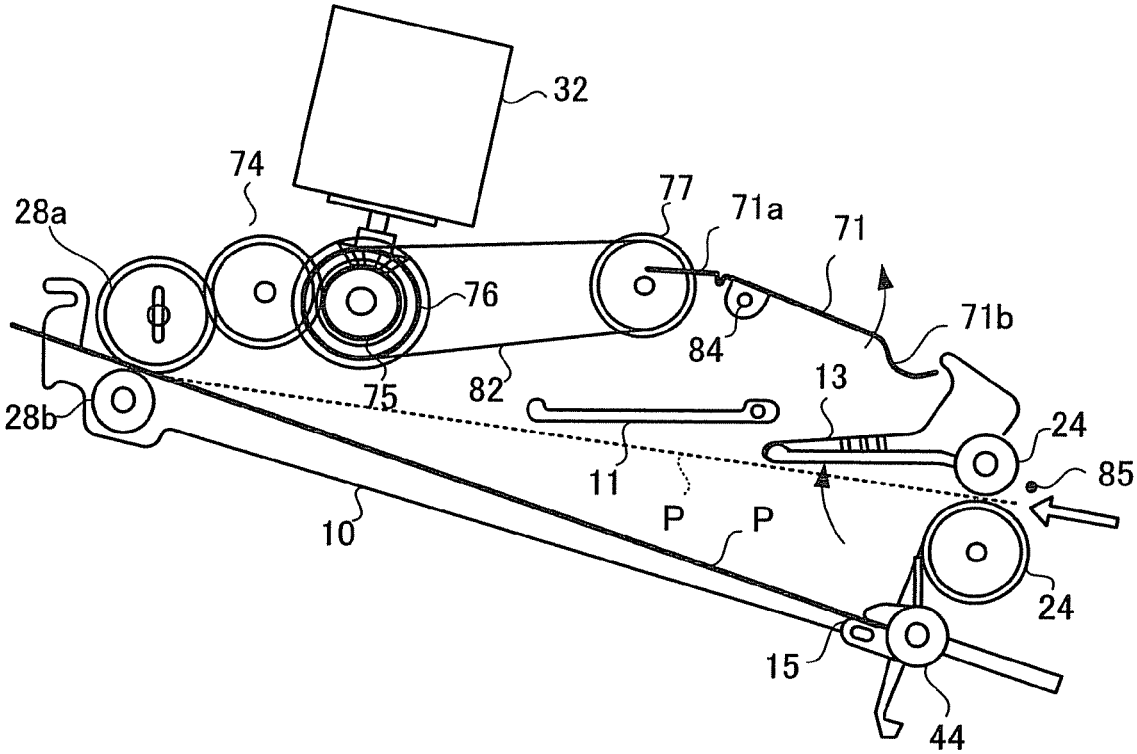
FIG. 15A and FIG. 15B are schematic illustrations of the operation of a principal part of a sheet post-processing apparatus according to the invention.
Figure 15B:
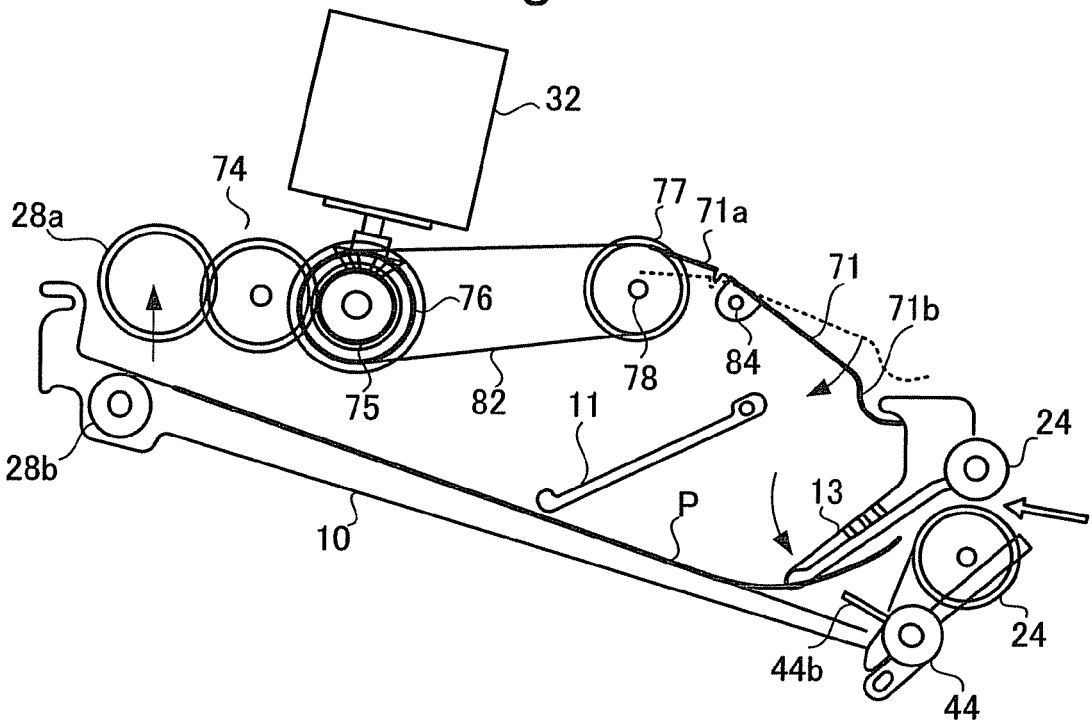

FIGS. 15A and 15B illustrate the operation of the arrangement shown in FIGS. 12 and 13. FIG. 15A illustrates a state where the first sheet P is being conveyed, whereas FIG. 15B illustrates a state where the second sheet P is being conveyed.

Referring firstly to FIG. 15A, the sheet P is conveyed toward the rotary roller pair 28 by the sheet feeding roller pair 24. The motor 32 is driven to rotate forwardly at this time so that the rotary roller pair 28 rotates to convey the sheet at the front end thereof. Since the sheet P is rigid, the stand-by tray guide pair 11 is made to swing upward (clockwise in FIG. 15A).

Thus, the sheet P that is shown as a dotted line is guided to move linearly in the direction indicated by the arrow in FIG. 15A. As the rear end of the sheet P leaves the sheet feeding roller pair 24, the sensor 85 detects the fact and the motor 32 is stopped. Then, the paddle 44 is driven to rotate and assist the rear end of the sheet P for its falling motion. Thus, the rear end of the first sheet P is reliably hold by a chuck 15.

When the motor 32 is driven to rotate forwardly, the one-way clutch 75 does not transmit the rotary motion of the motor to the pulley 76 so that the pulley 76, the belt 82 and the pulley 77 do not move and the cam 79 arranged on the rotary shaft 78 is at the position, for example, for lowering the end 71*a* of the lever 71.

Then, as a result, the other end 71*b* of the lever 71 is lifted up and the assist arm 13 is driven to move upward like the stand-by tray guide pair 11 and rigidly held to the lifted position. Thus, the sheet P is guided to move linearly and forwardly.

As the sensor 85 detects the fact that the rear end of the first sheet P passes the sheet feeding roller pair 24, the rotary roller 28*a* is moved upward and the motor 32 is driven to rotate backwardly.

As the second sheet P is conveyed by the sheet feeding roller pair 24, the rotary roller 28*a* is moved upward so as not to contact the rotary roller 28*b* as shown in FIG. 15B. Since the motor 32 is driven to rotate backward, the backward rotary motion of the motor 32 is transmitted to the pulley 76 by way of the one-way clutch 75 to by turn drive the rotary shaft 78 to rotate by way of the pulley 76, the belt 82 and the pulley 77 so that the cam 79 lifts up the end 71*a* of the lever 71.

Then, the other end 71*b* of the lever 71 is lowered to drive the assist arm 13 rotate to push down the sheet P at the front end thereof. Thus, the rear end of the sheet P is pressed against the stand-by tray 10 and the front ends of the stand-by tray guide pair 11 fall by their own weight so that the sheet P is reliably held in position by the assist arm 13 and the stand-by tray guide pair 11.

Then, the paddle 44 is driven to rotate in this state and the slapping section 44*b* slaps down the sheet P onto the processing tray 12. Thereafter, the operation described above by referring to FIGS. 15A and 15B is repeated so that each pair of sheets that is brought in sequentially is received by the stand-by tray 10 and led to the processing tray 12.

After the rear end of the first sheet P passes the sheet feeding roller pair 24, the rotary roller 28*a* is lifted up and the motor is driven to rotate backward. Thus, the assist arm 13 is turned to push down the rear end of the sheet P. Therefore, the rear end of each of the first and second sheets is pressed by the turned assist arm 13 after passing the sheet feeding roller pair 24.

Thus, according to the present invention, the rotary power of the motor 32 for driving the rotary roller pair 28 to rotate is utilized in such a way that the lever 71 is turned to actively move the assist arm 13 and press the rear end of the sheet P being conveyed in order to prevent it from curling and the sheet P from being misaligned when the motor 32 is driven to rotate backward.

Thus, according to the present invention, it is possible to regulate the sheets supplied from an image forming apparatus and guide them to the stand-by tray for post-processing such as stapling them.

It should be noted that the present invention is by no means limited to the above-described embodiment, which may be modified and altered in various different ways without departing from the spirit and scope of the invention.

For example, while the post-processing given to the sheets laid on the processing tray is a stapling process in the above description of the invention, post-processing is by no means limited to a stapling process and may alternatively be a hole punching process of forming a hole through the sheets. Additionally, it is not necessary to lay a plurality of sheets on the processing tray and only a single sheet may be subjected to post-processing.

Although exemplary embodiments of the present invention have been shown and described, it will be apparent to those having ordinary skill in the art that a number of changes, modifications or alternations to the invention as described herein may be made, non of which depart from the spirit of the present invention. All such changes, modifications and alterations should therefore be seen as within the scope of the present invention.

What is claimed is:

1. A sheet post-processing apparatus to post-process a sheet supplied from an image forming apparatus and delivering it, comprising:

a sheet feeding section including a pair of sheet feeding rollers to receive the sheet supplied from the image forming apparatus and conveying it to the downstream side;

a stand-by tray to receive the sheet delivered from the sheet feeding section and holding it on a stand-by status;

an assist arm arranged on an upper portion of a sheet conveying path so as to project toward the sheet delivery side of the pair of sheet feeding rollers and press from upside the sheet delivered by the sheet feeding roller pair against the standby tray, and adapted to be turned;

a motor rotatable both in a first direction and in a second direction opposite to the first direction;

an assist arm control section to control the assist arm by utilizing the rotary motion of the motor so as to immobilize the assist arm when the motor is driven to rotate in the first direction but turn the assist arm to press the rear end of the sheet delivered from the sheet feeding roller pair against the stand-by tray when the motor is driven to rotate in the second direction, the assist arm control section controls the assist arm so as to guide and discharge the first sheet, driving the motor to rotate in the first direction, while conveying the first sheet by means of the pair of sheet feeding rollers but press the second sheet, driving the motor to rotate in the second direction, while conveying the second sheet also by means of the pair of sheet feeding rollers;

a processing tray arranged below the stand-by tray and adapted to lay the sheet supplied from the image forming apparatus on it; and a post-processing section to post-process the sheet laid on the processing tray.

2. The apparatus according to claim 1, wherein the assist arm control section controls the assist arm so as to press the rear end of the first sheet after the first sheet passes the pair of sheet feeding rollers while conveying it and also press the rear end of the second sheet while conveying it, driving the motor to rotate in the second direction.

3. The apparatus according to claim 1, further comprising:

a slapping section to slap down the rear end of the first sheet and that of the second sheet delivered from the pair of sheet feeding rollers onto the processing tray.

4. A sheet post-processing apparatus to post-process a sheet supplied from an image forming apparatus and delivering it, comprising:

a pair of sheet feeding rollers to receive the sheet supplied from the image forming apparatus and conveying it to the downstream side;

a motor rotatable both in a first direction and in a second direction opposite to the first direction;

a sheet feeding section arranged in the moving direction of the sheet delivered from the pair of sheet feeding rollers and including a pair of rotary rollers adapted to be driven to rotate by the motor, the pair of rotary rollers being brought into contact with the sheet to deliver the sheet further downstream when the motor is driven to rotate in the first direction, and the pair of rotary rollers being held in a non-contact state when the motor is driven to rotate in the second direction;

a stand-by tray to receive the sheet delivered from the sheet feeding rollers and holding it on a stand-by status;

an assist arm supported to a shaft of one of the pair of sheet feeding rollers so as to be able to swing, and including a rotatable arm arranged so as to project toward the sheet delivery side of the pair of sheet feeding rollers and adapted to be turned from a first state of guiding the sheet delivered from the pair of sheet feeding rollers along a conveyance route to a second state of pressing the rear end of the sheet delivered from the pair of sheet feeding rollers against the stand-by tray and vice versa;

an assist arm control section having a lever adapted to turn, utilizing the rotary force of the motor of the sheet feeding section, and control the turning motion of the assist arm when the motor is driven to rotate in the second direction;

a processing tray arranged below the stand-by tray and adapted to lay the sheet supplied from the image forming apparatus on it; and a post-processing section to post-process the sheet laid on the processing tray.

5. The apparatus according to claim 4, wherein the assist arm control section controls the assist arm so as to guide and discharge the first sheet, driving the motor to rotate in the first direction, while conveying the first sheet by means of the pair of sheet feeding rollers but press the second sheet, driving the motor to rotate in the second direction, while conveying the second sheet also by means of the pair of sheet feeding rollers.

6. The apparatus according to claim 4, wherein the assist arm control section controls the assist arm so as to press the rear end of the first sheet after the first sheet passes the pair of sheet feeding rollers while conveying it and also press the rear end of the second sheet while conveying it, driving the motor to rotate in the second direction.

7. The apparatus according to claim 4, wherein the sheet feeding section includes a gear train adapted to transmit the rotary motion of the motor to the pair of rotary rollers when the motor is driven to rotate in the first direction and a cam adapted to rotate when the motor is driven to rotate in the second direction; and the assist arm control section turns the lever by means of the rotary motion of the cam and controls the assist arm so as to drive it to turn when the motor is driven to rotate in the second direction.

8. A sheet post-processing apparatus to post-process a sheet supplied from an image forming apparatus and delivering it, comprising:

a pair of sheet feeding rollers to receive the sheet supplied from the image forming apparatus and conveying it to the downstream side;

a motor rotatable both in a first direction and in a second direction opposite to the first direction;

a sheet feeding section arranged in the moving direction of the sheet delivered from the pair of sheet feeding rollers and including a pair of rotary rollers adapted to be driven to rotate by the motor, the pair of rotary rollers being brought into contact with the sheet to deliver the sheet further downstream when the motor is driven to rotate in the first direction, and the pair of rotary rollers being held in a non-contact state when the motor is driven to rotate in the second direction;

a stand-by tray to receive the sheet delivered from the sheet feeding rollers and holding it on a stand-by status;

an assist arm arranged between the stand-by tray guides at the lateral sides, and including a rotatable arm arranged so as to project toward the sheet delivery side of the pair of sheet feeding rollers and adapted to be turned from a first state of guiding the sheet delivered from the pair of sheet feeding rollers along a conveyance route to a second state of pressing the rear end of the sheet delivered from the pair of sheet feeding rollers against the stand-by tray and vice versa;

an assist arm control section having a lever adapted to turn, utilizing the rotary force of the motor of the sheet feeding section, and control the turning motion of the assist arm when the motor is driven to rotate in the second direction;

a processing tray arranged below the stand-by tray and adapted to lay the sheet supplied from the image forming apparatus on it;

a post-processing section to post-process the sheet laid on the processing tray;

a pair of stand-by tray guides to guide the lateral sides of the sheet in the conveying direction thereof in order to regulate the movement and the attitude of the sheet delivered from the pair of sheet feeding rollers to the stand-by tray.

9. The apparatus according to claim 8, wherein the assist arm control section controls the assist arm so as to guide and discharge the first sheet, driving the motor to rotate in the first direction, while conveying the first sheet by means of the pair of sheet feeding rollers but press the second sheet, driving the motor to rotate in the second direction, while conveying the second sheet also by means of the pair of sheet feeding rollers.

10. The apparatus according to claim 8, wherein the assist arm control section controls the assist arm so as to press the rear end of the first sheet after the first sheet passes the pair of sheet feeding rollers while conveying it and also press the rear end of the second sheet while conveying it, driving the motor to rotate in the second direction.

11. The apparatus according to claim 8, wherein the sheet feeding section includes a gear train adapted to transmit the rotary motion of the motor to the pair of rotary rollers when the motor is driven to rotate in the first direction and a cam adapted to rotate when the motor is driven to rotate in the second direction; and the assist arm control section turns the lever by means of the rotary motion of the cam and controls the assist arm so as to drive it to turn when the motor is driven to rotate in the second direction.

12. A sheet post-processing method for post-processing a sheet supplied from an image forming apparatus, comprising:

receiving the sheet supplied from the image forming apparatus by a pair of sheet feeding rollers and conveying to the downstream side;

providing a motor rotatable both in a first direction and in a second direction opposite to the first direction and a pair of rotary rollers adapted to be driven to rotate by the motor arranged in the moving direction of the sheet delivered from the pair of sheet feeding rollers;

delivering the sheet further downstream to the pair of rotary rollers being brought into contact with the sheet when the motor is driven to rotate in the first direction, and the pair of rotary rollers being held in a non-contact state when the motor is driven to rotate in the second direction;

receiving the sheet delivered from the sheet feeding rollers by a stand-by tray and holding on a stand-by status;

providing an assist arm supported to a shaft of one of the pair of sheet feeding rollers so as to be able to swing and including a rotatable arm arranged so as to project toward the sheet delivery side of the pair of sheet feeding rollers;

controlling the turning motion of the assist arm when the motor is driven to rotate in the second direction by a lever adapted to turn utilizing the rotary force of the motor, and the assist arm adapted to be turned from a first state of guiding the sheet delivered from the pair of sheet feeding rollers along a conveyance route to a second state of pressing the rear end of the sheet delivered from the pair of sheet feeding rollers against the stand-by tray and vice versa;

laying the sheet supplied from the image forming apparatus on a processing tray arranged below the stand-by tray; and post-processing the sheet laid on the processing tray.

13. The method according to claim 12, wherein controlling the assist arm so as to guide and discharge the first sheet, driving the motor to rotate in the first direction, while conveying the first sheet by the pair of sheet feeding rollers but press the second sheet, driving the motor to rotate in the second direction, while conveying the second sheet also by the pair of sheet feeding rollers.

14. The method according to claim 12, wherein controlling the assist arm so as to press the rear end of the first sheet after the first sheet passes the pair of sheet feeding rollers while conveying it and also press the rear end of the second sheet while conveying it, driving the motor to rotate in the second direction.

15. The method according to claim 12, wherein adapting a gear train to transmit the rotary motion of the motor to the pair of rotary rollers when the motor is driven to rotate in the first direction and a cam adapted to rotate when the motor is driven to rotate in the second direction; and turning the lever by the rotary motion of the cam and controlling the assist arm so as to drive it to turn when the motor is driven to rotate in the second direction.

* * * * *